US010794061B2

(12) United States Patent
Shebala

(10) Patent No.: US 10,794,061 B2
(45) Date of Patent: Oct. 6, 2020

(54) ROOFING ALIGNMENT ASSEMBLY

(71) Applicant: Michael P. Shebala, Espanola, NM (US)

(72) Inventor: Michael P. Shebala, Espanola, NM (US)

( * ) Notice: Subject to any disclaimer, the term of this patent is extended or adjusted under 35 U.S.C. 154(b) by 213 days.

(21) Appl. No.: 16/019,987

(22) Filed: Jun. 27, 2018

(65) Prior Publication Data

US 2020/0002951 A1 Jan. 2, 2020

(51) Int. Cl.
*E04D 15/02* (2006.01)

(52) U.S. Cl.
CPC ..... *E04D 15/025* (2013.01)

(58) Field of Classification Search
CPC ..... E04D 15/025; G01B 5/25; G01B 5/14; G01B 5/24; G01B 11/275
USPC ..... 33/645
See application file for complete search history.

(56) References Cited

U.S. PATENT DOCUMENTS 1,035,062 A 8/1912 Vroome
2,623,290 A * 12/1952 Kampel ..... E04G 21/1825 33/409
3,408,742 A * 11/1968 Caprio ..... E04G 21/1825 33/409
4,057,903 A 11/1977 Cantera
4,149,320 A 4/1979 Troyer
D259,706 S 6/1981 Smith
4,375,721 A * 3/1983 Ueda ..... G01B 3/1071 33/759
5,359,782 A * 11/1994 Langmaid ..... B25H 7/00 33/415
5,479,713 A * 1/1996 Wood ..... E04G 21/1825 33/407
6,212,782 B1 4/2001 Eisenmenger
6,374,504 B1 * 4/2002 Graham ..... E04G 21/1891 33/1 LE
6,412,184 B1 * 7/2002 Heavner ..... E04G 21/1808 33/1 LE
6,523,275 B2 2/2003 Medford
7,409,771 B2 * 8/2008 Bond ..... B65H 75/04 33/1 LE
7,617,613 B2 11/2009 Merryfield
7,673,393 B1 * 3/2010 Hudson ..... E04G 21/1825 33/407

(Continued)

FOREIGN PATENT DOCUMENTS

WO WO02057710 7/2002

*Primary Examiner* — Yaritza Guadalupe-McCall

(57) ABSTRACT

A roofing alignment assembly includes a building has a roof. The roof has a top surface, an eave edge, a first gable edge and a second gable edge. A pair of jigs is provided and each of the jigs is removably coupled to the top surface of the roof. Each of the jigs is aligned with a respective one of the first and second gable edges. Moreover, each of the jigs has a front side and the front side on each of the jigs is spaced a measured distance from the eave edge when the jigs are positioned on the roof. A string is stretched between the front side of each of the jigs when the jigs are positioned on the roof. Thus, the string is oriented collinear with the eave edge of the roof and the string is spaced the measured distance from the roof. In this way the string defines a straight edge for aligning roofing material that is being installed on the roof.

4 Claims, 4 Drawing Sheets

(56) References Cited

U.S. PATENT DOCUMENTS

| | | | | |
|---|---|---|---|---|
| 7,779,546 | B2 * | 8/2010 | Bond | G01C 15/02 33/1 LE |
| 8,209,874 | B1 * | 7/2012 | Tribble | G01C 15/06 33/286 |
| 8,407,947 | B2 * | 4/2013 | Yaggi, Jr. | E04D 12/006 248/300 |
| 2007/0029433 | A1 * | 2/2007 | Bond | B65H 75/04 242/400.1 |
| 2007/0089312 | A1 * | 4/2007 | Wade | E04G 21/1833 33/409 |
| 2007/0266583 | A1 | 11/2007 | Furrow | |
| 2008/0000096 | A1 * | 1/2008 | Wade | E04G 21/1833 33/404 |
| 2008/0301958 | A1 * | 12/2008 | Darty | E04G 21/18 33/409 |
| 2020/0002951 | A1 * | 1/2020 | Shebala | E04D 15/025 |

* cited by examiner

ROOFING ALIGNMENT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to alignment devices and more particularly pertains to a new alignment device for

BRIEF SUMMARY OF THE INVENTION

An embodiment of the disclosure meets the needs presented above by generally comprising a building has a roof. The roof has a top surface, an eave edge, a first gable edge and a second gable edge. A pair of jigs is provided and each of the jigs is removably coupled to the top surface of the roof. Each of the jigs is aligned with a respective one of the first and second gable edges. Moreover, each of the jigs has a front side and the front side on each of the jigs is spaced a measured distance from the eave edge when the jigs are positioned on the roof. A string is stretched between the front side of each of the jigs when the jigs are positioned on the roof. Thus, the string is oriented collinear with the eave edge of the roof and the string is spaced the measured distance from the roof. In this way the string defines a straight edge for aligning roofing material that is being installed on the roof.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
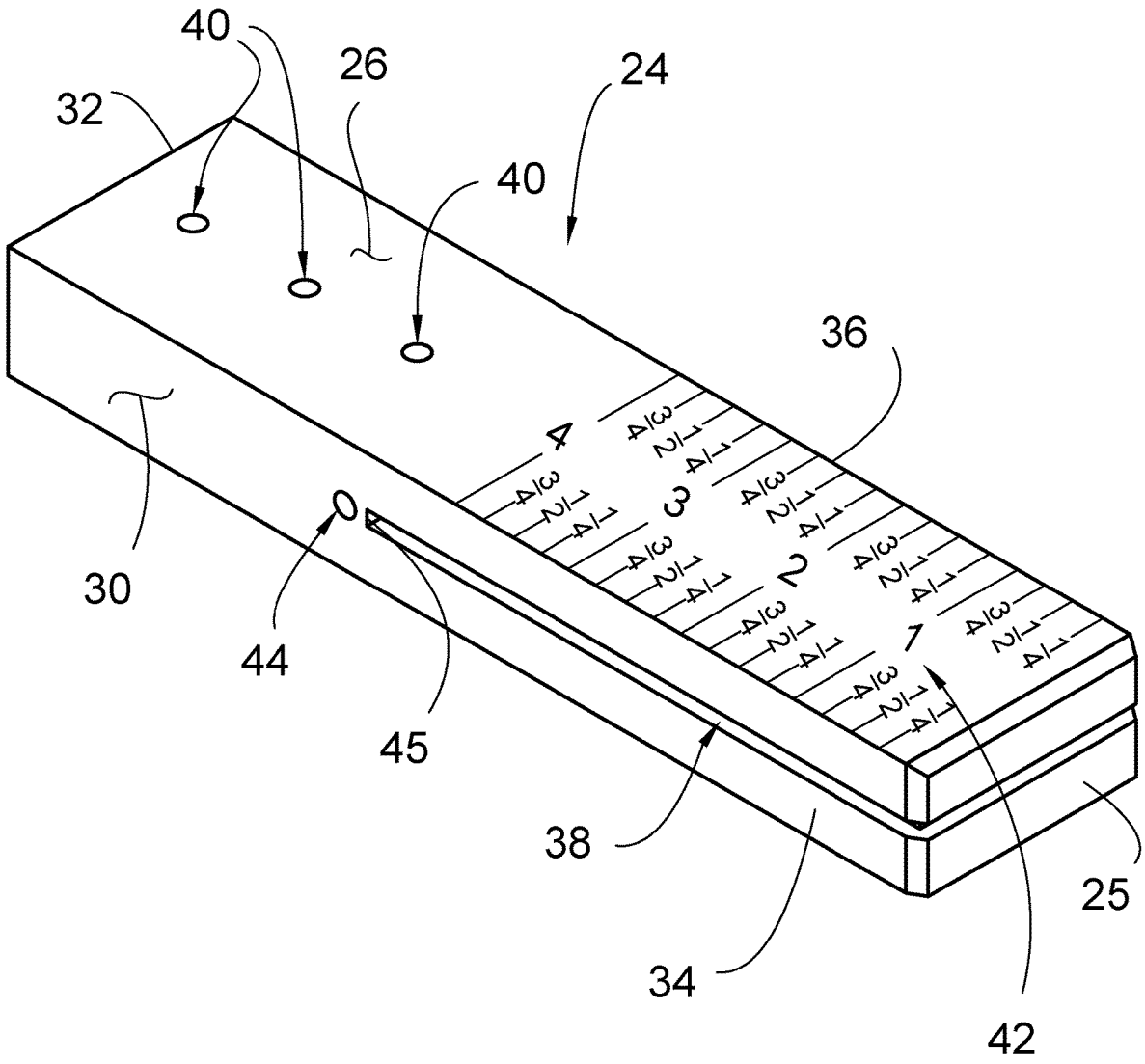
FIG. 1 is a top perspective view of a jig of a roofing alignment assembly according to an embodiment of the disclosure.
Figure 2:
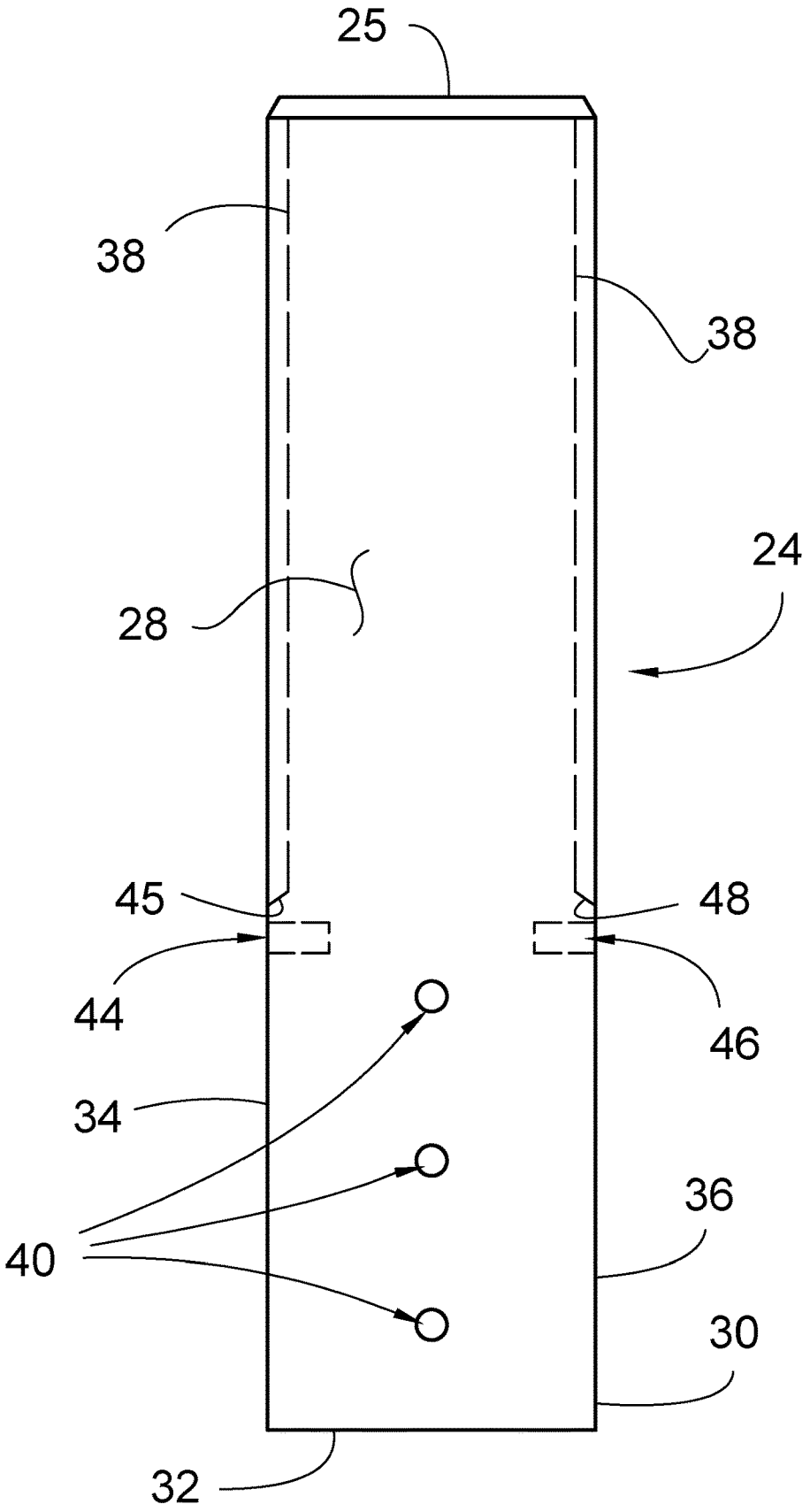
FIG. 2 is a bottom phantom view of an embodiment of the disclosure.
Figure 3:
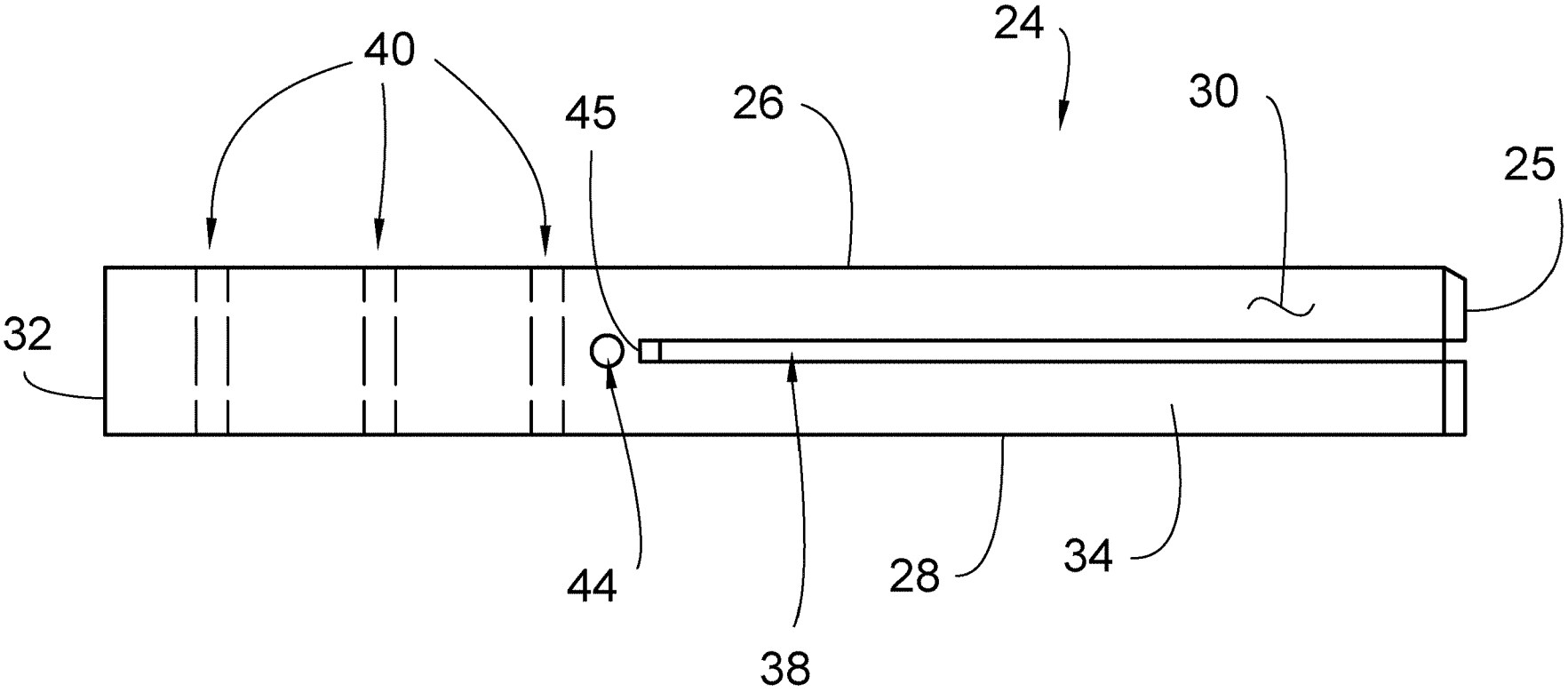
FIG. 3 is a right side phantom view of an embodiment of the disclosure.
Figure 4:
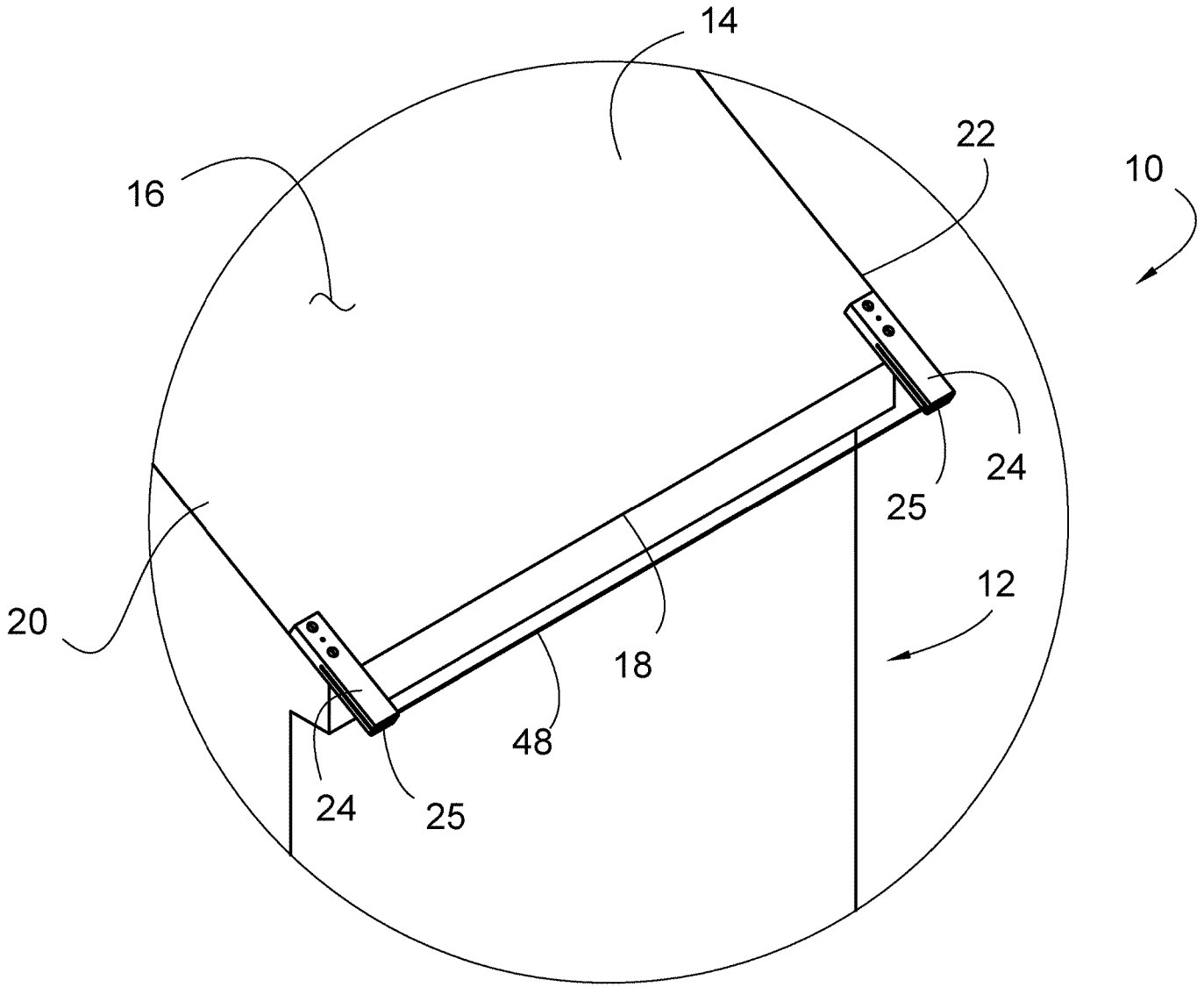
FIG. 4 is a perspective in-use view of an embodiment of the disclosure.

With reference now to the drawings, and in particular to FIGS. 1 through 4 thereof, a new alignment device embodying the principles and concepts of an embodiment of the disclosure and generally designated by the reference numeral 10 will be described.

As best illustrated in FIGS. 1 through 4, the roofing alignment assembly 10 generally comprises a building 12 that has a roof 14. The roof 14 has a top surface 16, an eave edge 18, a first gable edge 20 and a second gable edge 22. The building 12 may be any structure that has a pitched, shingled roof 14. A pair of jigs 24 is provided and each of the jigs 24 is removably coupled to the top surface 16 of the roof 14. Each of the jigs 24 is aligned with a respective one of the first 20 and second 22 gable edges. Moreover, each of the jigs 24 has a front side 25 and the front side 25 on each of the jigs 24 is spaced a measured distance from the eave edge 18 when the jigs 24 are positioned on the roof 14.

Each of the jigs 24 has a top surface 26, a bottom surface 28 and an outer surface 30 extending therebetween. The outer surface 30 includes the front side 25, a back side 32, a first lateral side 34 and a second lateral side 36. The outer surface 30 of each of the jigs 24 has a groove 38 extending inwardly therein and the groove 38 on each of the jigs 24 extends along the front side 25 and partially along each of the first 34 and second 36 lateral sides. Each of the jigs 24 has a plurality of fastener holes 40 extending through the top surface 26 and the bottom surface 28. The fastener holes 40 in each of the jigs 24 are spaced apart from each other and are distributed from the back side 32 toward the front side 25. Moreover, a fastener, such as a screw or nail, is extended through each of the fastener holes 40 in each of the jigs 24 to engage the top surface 26 of the roof 14 thereby retaining the jigs 24 on the roof 14. Additionally, each of the jigs 24 is oriented such that the front side 25 of the outer surface 30 of each of the jigs 24 lies on a line that is oriented parallel to the eave edge 18 of the roof 14. Each of the jigs may have a length of approximately 8.0 inches, a width of approximately 2.0 inches and a thickness of approximately 1.0 inches.

The top surface 26 of each of the jigs 24 has ruler indicia 42 printed thereon and the ruler indicia 42 on each of the jigs 24 graduates from the front side 25 of the outer surface 30 of the jigs 24 toward the back side 32 of the outer surface 30 of the jigs 24. The ruler indicia 42 may include ¼ inch incremental markings along a total length of 4.0 inches. Each of the jigs 24 is positionable on the roof 14 to align the eave edge 18 with a selected point along the ruler indicia 42. In this way the measured distance between the front side 25 and the eave edge 18 is determined.

The first lateral side 34 of the outer surface 30 of each of the jigs 24 has a first well 44 extending inwardly therein. The first well 44 on each of the jigs 24 is spaced from a first terminal end 45 of the groove 38 on each of the jigs 24. The second lateral side 36 of the outer surface 30 of each of the jigs 24 has a second well 46 extending inwardly therein. The second well 46 on each of the jigs 24 is spaced from a second terminal end 48 of the groove 38 on each of the jigs 24.

A string 48 is provided and the string 48 is stretched between the front side 25 of each of the jigs 24 when the jigs 24 are positioned on the roof 14. The string 48 is oriented collinear with the eave edge 18 of the roof 14 and is spaced the measured distance from the roof 14. In this way the string 48 to defines a straight edge for aligning roofing material that is being installed on the roof 14. The roofing material may be shingles, sheathing, underlayment and any other components of roofing systems.

In use, each of the jigs 24 is positioned on the top surface 26 of the roof 14 prior to installing the roof 14 ing materials. Moreover, each of the jigs 24 is manipulated to align the eave edge 18 of the roof 14 with a selected point along the ruler indicia 42 on the jigs 24. In this way the front side 25 of each of the jigs 24 is spaced the measured distance from the eave edge 18. The fasteners are extended through each of the jigs 24 to releasably fasten the jigs 24 to the roof 14. A first end of the string 48 is inserted into the first well 44 on the jig that is aligned with the first gable edge 20. A second end of the string 48 is inserted into the second well 46 on the jig that is aligned with the second gable edge 22. Moreover, the string 48 is positioned to extend along the groove 38 on the front side 25 of the outer surface 30 of each of the jigs 24. In this way the string 48 defines a straight edge on the roof 14 for aligning the roofing material along the eave edge 18 when the roofing material is being installed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A roofing alignment system being configured to precisely align roofing materials being installed on a roof, said assembly comprising:

a building having a roof, said roof having a top surface, an eave edge, a first gable edge and a second gable edge;

a pair of jigs, each of said jigs being removably coupled to said top surface of said roof, each of said jigs being aligned with a respective one of said first and second gable edges, each of said jigs having a front side, said front side on each of said jigs being spaced a measured distance from said eave edge when said jigs are positioned on said roof;

a string being stretched between said front side of each of said jigs when said jigs are positioned on said roof, said string being oriented collinear with said eave edge of said roof and being spaced said measured distance from said roof thereby facilitating said string to define a straight edge for aligning roofing material being installed on said roof;

each of said jigs having a top surface, a bottom surface, and an outer surface extending therebetween, said outer surface having said front side, a back side, a first lateral side and a second lateral side, said outer surface of each of said jigs having a groove extending inwardly therein, said groove on each of said jigs extending along said front side and partially along each of said first and second lateral sides;

each of said jigs having a plurality of fastener holes extending through said top surface and said bottom surface, said fastener holes in each of said jigs being spaced apart from each other and being distributed from said back side toward said front side, each of said fastener holes in each of said jigs having fasteners being extended therethrough and engaging said top surface of said roof to retain said jigs on said roof having said front side of said outer surface of each of said jigs lying on a line being oriented parallel to said eave edge of said roof;

said first lateral side of said outer surface of each of said jigs having a first well extending inwardly therein, said first well on each of said jigs being spaced from a first terminal end of said groove on each of said jigs; and said second lateral side of said outer surface of each of said jigs having a second well extending inwardly therein, said second well on each of said jigs being spaced from a second terminal end of said groove on each of said jigs.

2. The system according to claim 1, wherein said top surface of each of said jigs has ruler indicia being printed thereon, said ruler indicia on each of said jigs graduating from said front side of said outer surface of said jigs toward said back side of said outer surface of said jigs, each of said jigs being positionable on said roof to align said eave edge with a selected point along said ruler indicia thereby determining said measured distance between said front side and said eave edge.

3. The system according to claim 1, wherein a first end of said string is inserted into said first well on said jig being aligned with said first gable edge, a second end of said string being inserted into said second well on said jig being aligned with said second gable edge having said string extending along said groove on said front side of said outer surface of each of said jigs.

4. A roofing alignment system being configured to precisely align roofing materials being installed on a roof, said assembly comprising:

a building having a roof, said roof having a top surface, an eave edge, a first gable edge and a second gable edge;

a pair of jigs, each of said jigs being removably coupled to said top surface of said roof, each of said jigs being aligned with a respective one of said first and second gable edges, each of said jigs having a front side, said front side on each of said jigs being spaced a measured distance from said eave edge when said jigs are positioned on said roof, each of said jigs having a top surface, a bottom surface, and an outer surface extending therebetween, said outer surface having said front side, a back side, a first lateral side and a second lateral side, said outer surface of each of said jigs having a groove extending inwardly therein, said groove on each of said jigs extending along said front side and partially along each of said first and second lateral sides, each of said jigs having a plurality of fastener holes extending through said top surface and said bottom surface, said fastener holes in each of said jigs being spaced apart from each other and being distributed from said back side toward said front side, each of said fastener holes in each of said jigs having fasteners being extended therethrough and engaging said top surface of said roof to retain said jigs on said roof having said front side of said outer surface of each of said jigs lying on a line being oriented parallel to said eave edge of said roof, said top surface of each of said jigs having ruler indicia being printed thereon, said ruler indicia on each of said jigs graduating from said front side of said outer surface of said jigs toward said back side of said outer surface of said jigs, each of said jigs being positionable on said roof to align said eave edge with a selected point along said ruler indicia thereby determining said measured distance between said front side and said eave edge, said first lateral side of said outer surface of each of said jigs having a first well extending inwardly therein, said first well on each of said jigs being spaced from a first terminal end of said groove on each of said jigs, said second lateral side of said outer surface of each of said jigs having a second well extending inwardly therein, said second well on each of said jigs being spaced from a second terminal end of said groove on each of said jigs; and a string being stretched between said front side of each of said jigs when said jigs are positioned on said roof, said string being oriented collinear with said eave edge of said roof and being spaced said measured distance from said roof thereby facilitating said string to define a straight edge for aligning roofing material being installed on said roof, a first end of said string being inserted into said first well on said jig being aligned with said first gable edge, a second end of said string being inserted into said second well on said jig being aligned with said second gable edge having said string extending along said groove on said front side of said outer surface of each of said jigs.

* * * * *